US005330288A

United States Patent [19]

Ferrari

[11] Patent Number: 5,330,288

[45] Date of Patent: Jul. 19, 1994

[54] UNDERGROUND STORAGE TANK

[75] Inventor: Franco Ferrari, La Spezia, Italy

[73] Assignee: Inq. Nino Ferrari USA Inc., Montclair, N.J.

[21] Appl. No.: 52,177

[22] Filed: Apr. 23, 1993

[30] Foreign Application Priority Data

Apr. 28, 1992 [IT] Italy ..... GE92A000051

[51] Int. Cl.[5] ..... B65G 5/00

[52] U.S. Cl. ..... 405/55; 405/150.1; 405/151

[58] Field of Search ..... 405/52, 53, 55, 150.1, 405/151, 153

[56] References Cited

U.S. PATENT DOCUMENTS

| | | | |
|---|---|---|---|
| 1,853,224 | 4/1932 | Proctor | 405/153 |
| 2,080,020 | 5/1937 | Wilkoff | 405/153 |
| 4,717,285 | 1/1988 | Pulkkinen | 405/55 |

*Primary Examiner*—David H. Corbin
*Attorney, Agent, or Firm*—Rosenman & Colin

[57] ABSTRACT

Underground storage tank consisting of an internal metal structure (1), of a static external facing (2) and of a filler (4) such a hot blown bitumen located between the metal structure (1) and the static facing (2), the outer surface of the metal structure (1) presenting welded structural shapes (7) properly spaced and cross connected to increase the bond between the metal structure (1) and the filler (4).

6 Claims, 2 Drawing Sheets

UNDERGROUND STORAGE TANK

BACKGROUND OF THE INVENTION

1. Field of the Invention

This invention covers an underground storage tank for storage of liquids of any nature whatsoever.

2. Description of the Related Art

These tanks are usually cylindrical with horizontal axis and are consisting of an internal the metal containment structure, an external static facing in touch with the soil in plain simple or reinforced concrete and a filler located between the metal containment structure and the static facing.

Large underground storage tanks are normally built with hot press rolled metal elements or large sized rings, the transverse edges of which are provided with angle sections, apt automatically to create transverse and longitudinal channels after the rings have been jointed and with the aid of flat sections, for easy detection and sealing of any leaks.

Such transverse channels can also be obtained with omega shapes and flat sections, welded onto the rings which, in this case, are without angle-shapes. The latter solution is preferable since hot-press rolling of the rings, stiffened by shaping, is rather difficult.

These large sized metal elements allow for an easier and lower-cost assembly of the metal structure erected at the crown of the static concrete facing on which it is resting and which externally protects it, since handling and installation of these elements is much easier and much more rational than achievable with previous assembly and erection techniques.

The metal containment structure is supported by the static reinforced or plain concrete facing, by means of U-bolts and a filler is poured or injected into the hollow space between the metal structure and static facing.

The static stability of these large underground tanks is currently guaranteed by providing the metal structure and the static facing with a separate static stability without taking their reciprocal interaction into account. An important advantage in building such large sized underground tanks can be achieved if the system is conceived as a metal containment structure, static facing, filler and surrounding soil, i.e. as one single interacting complex structure so that all its components are all together and directly contributing to the structural stability of these tanks which will thus be configurated according to the underground cavity-walled storage tank design.

By meeting this requirement, the resistance parameters and thickness of the metal structure and of the static facing may be reduced by reducing the quantity of material.

These tanks, thus designed, are known from EP-A-0325683 and its related U.S. Pat. No. 4,915,545, in which a special hot blown bitumen is injected between the static facing and the metal shell at a temperature of about 200°—200° C.

The construction of such underground storage tanks, according to these known patents is therefore rather inexpensive and stress resisting, including seismic stresses, but this invention has the aim to provide an even better structural stability to the three tank components, i.e. its static facing, metal shell and hot blown bitumen filler.

The metal shell is indeed the tank component most exposed to stresses and strains, especially during filling and emptying of the tank. Such strains in the metal shell will generate deformation of the filler, although these strains are usually well absorbed since hot blown bitumen is used as a filler, having excellent viscous-elastic properties.

SUMMARY OF THE INVENTION

To ensure a continuous, close and optimum bond between blown bitumen and metal shell so as to obtain a uniform structural assembly of the three tank components, the outer surface of the metal rings forming the shell, according to this invention, is designed to improve the bond between metal shell and hot blown bitumen, by means of structural shapes of various kinds, externally welded onto the rings.

BRIEF DESCRIPTION OF THE DRAWINGS

The invention in question is illustrated in its practical and exemplifying implementation in the enclosed drawings, in which.

DETAILED DESCRIPTION OF THE PREFERRED EMBODIMENT

Figure 1:
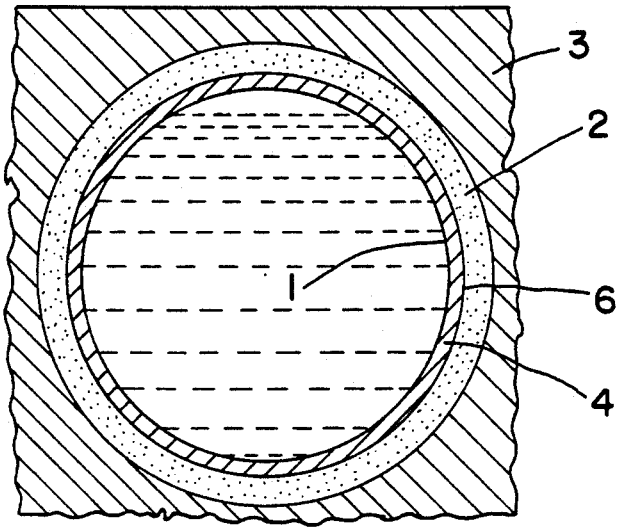
FIG. 1 shows a schematic cross section of an underground storage tank.

With reference to FIG. 1, 1 indicates the metal structure of the tank, 2 the static facing in plain or reinforced concrete, 3 the surrounding soil. The metal structure 1 is supported inside the static facing 2 by insulating U-bolts secured to the external facing 2.

The filler 4 is to be located between the metal structure 1 and the static facing 2; the filler is to be hot poured or injected through openings in the metal structure 1 which openings will be closed afterwards. The stresses and strains in the metal structure 1 shall be transmitted through the filler 4 to the static facing 2 and vice-versa and it has been found that hot blown bitumen is particularly suitable for this purpose, since it has the following average characteristics:

| | |
|---|---|
| penetration depth at 25° C. | 20–30 dmm |
| softening point | 80°–115° C. |
| Fraas breakpoint | −5°–12° C. |
| ductility at 25° C. | min. 3 cm |
| flash point | min. 240°–260° C. |
| specific gravity at 25/25° C. | 1.01–1.05 gr/cm3 |

After cooling down, this blown bitumen, has sufficient plasticity to transmit the stresses without causing permanent deformation and without breaking, to the tank components and the bitumen is poured into the hollow space at a temperature ranging between 200° and 220° C. so as completely to fill the space between the metal structure and the static facing.

As said before, the utilization of this filler guarantees the overall stability of the tank with its metal structure and static facing, the main sections of which may be calculated for a lower strength than currently required by design criteria and, because of the excellent visco-elastic properties of blown bitumen, the metal containment structure will be no longer subject to the stresses caused by soil deformation in case of seismic waves.

Figure 2:
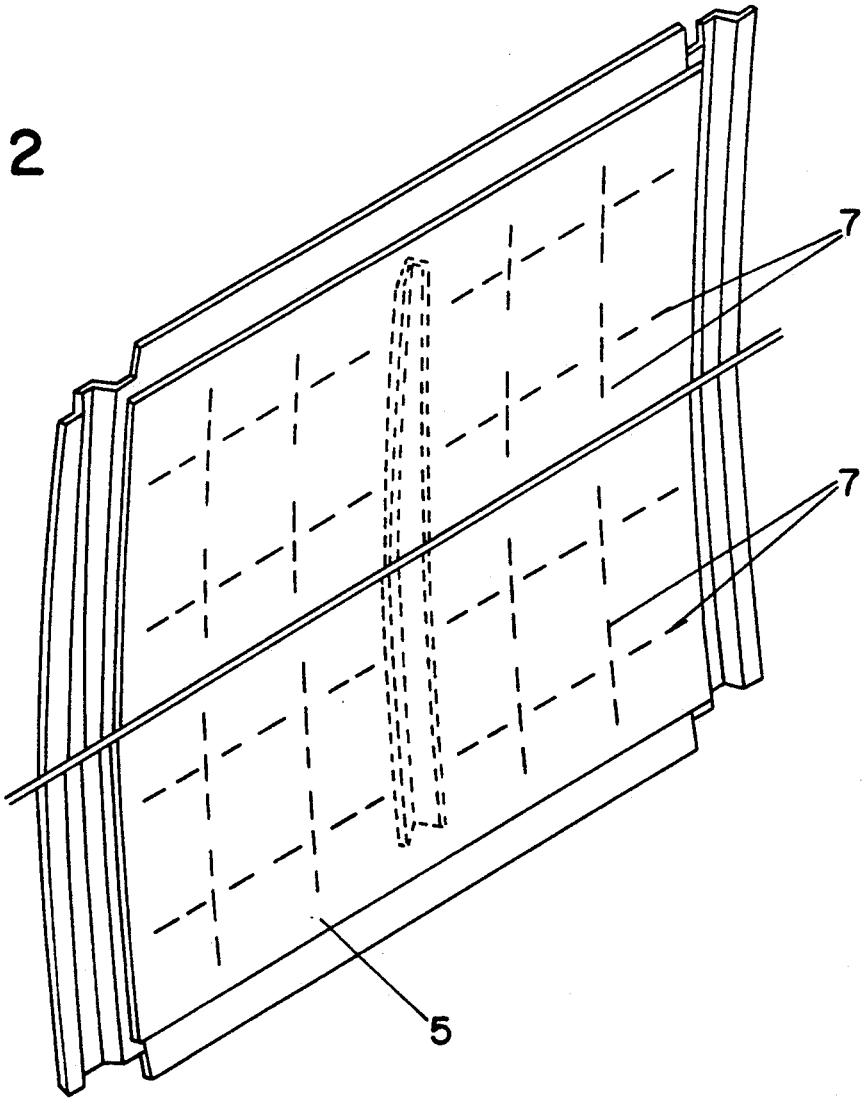
FIG. 2 shows a perspective view of a ring of the metal structure.
Figure 3:
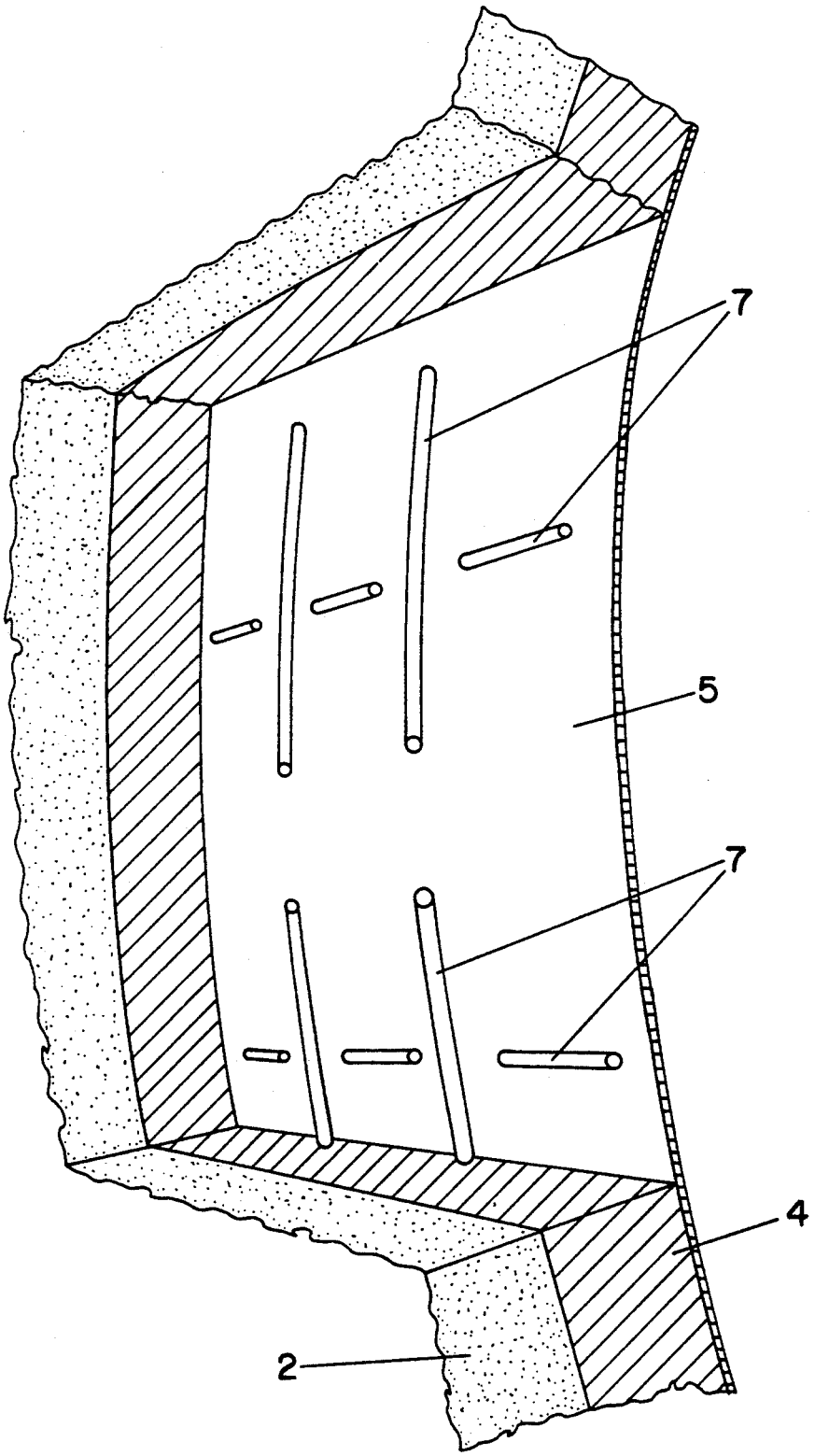
FIG. 3 shows an exploded view of the tank components with a ring featuring external structural shapes to improve the bond between the bitumen filler and the plates.

The FIGS. 2 and 3 show, according to this invention, how to ensure and heighten the bond between the metal structure and the hot blown bitumen filler. This bond is improved by structural shapes properly secured by welding to the outer surface of the plates 5 and in the drawings, these sections are consisting of properly spaced and cross-connected round bars, 7. This implementation is only by way of example and informative since the structural shapes may be of any kind (flats, angle or Z-shaped etc.) and may be placed in any horizontal or transverse direction as shown in the drawings or even raking.

Furthermore, externally projecting elements may be welded onto the plates. Obviously, this description given for the longitudinal shell is also valid for its front and rear header, whether flat or crowned.

No need to say that the description regarding cylindrical tanks with horizontal axis is also valid for tanks of any other configuration and implementation (whether upright, subvertical, spherical etc.).

I claim:

1. An underground liquid storage tank, comprising:

(a) an annular metal liner extending along a generally longitudinal axis, said liner including a plurality of curved plates having interior surfaces bounding a liquid storage chamber, and exterior surfaces located opposite the interior surfaces;

(b) an annular concrete facing concentric with said axis, surrounding the liner, and bounding an annular space with the exterior surfaces of the plates;

(c) a plurality of structural elements fixedly mounted on the exterior surfaces of the plates and located within said annular space; and (d) a viscous, settable, elastic filler filling said annular space and encapsulating the elements therein to form a strengthened elastic bond between the liner and the filler.

2. The tank according to claim 1, wherein the elements are metal and are welded onto the plates.

3. The tank according to claim 1, wherein the elements are spaced apart along said axis.

4. The tank according to claim 1, wherein the elements are co-linear along said axis.

5. The tank according to claim 1, wherein at least one of the elements extends transversely of said axis.

6. The tank according to claim 1, wherein the filler is a bitumen pourable into said annular space at a temperature ranging from about 200° C. to about 220° C.

* * * * *